US005974928A

United States Patent [19]

Boldrini

[11] Patent Number: 5,974,928

[45] Date of Patent: Nov. 2, 1999

[54] DEVICE FOR CUTTING A STRIP OF SHEET MATERIAL INTO BLANKS

[75] Inventor: Fulvio Boldrini, Ferrara, Italy

[73] Assignee: G.D S.p.A., Bologna, Italy

[21] Appl. No.: 09/089,139

[22] Filed: Jun. 2, 1998

[30] Foreign Application Priority Data

Jun. 2, 1997 [IT] Italy ..... BO97A0328

[51] Int. Cl.[6] ..... B26D 5/08; B23Q 7/00

[52] U.S. Cl. ..... 83/562; 83/155.1; 83/100; 83/353; 83/355

[58] Field of Search ..... 83/155.1, 356, 83/931, 353, 355, 100, 177, 658, 561, 562, 354

[56] References Cited

U.S. PATENT DOCUMENTS 3,483,780 12/1969 Hudson ..... 83/155.1

4,455,902 6/1984 Schmitz ..... 83/356

5,787,776 8/1998 Nishimoto ..... 83/355

*Primary Examiner*—M. Rachuba

*Assistant Examiner*—Sean Pryor

*Attorney, Agent, or Firm*—Pillsbury Madison & Sutro LLP

[57] ABSTRACT

A continuous strip of sheet paper material is divided into blanks by a device comprising a cutter and an anvil rendered capable of sliding movement one in relation to the other and establishing a cutting position toward which the strip is advanced by way of a passage incorporated into the anvil; the cutter is reciprocated across the anvil in such a manner as to pass through the cutting position transversely to the strip, alternating between two limit positions on opposite sides of the passage, the geometry being such that the cutter will vacate the passage entirely when occupying either one of the two limit positions.

8 Claims, 2 Drawing Sheets

DEVICE FOR CUTTING A STRIP OF SHEET MATERIAL INTO BLANKS

BACKGROUND OF THE INVENTION

The present invention relates to a device for cutting a strip of sheet material into blanks.

In particular, the present invention relates to a device for cutting strip paper material, and finds application to advantage in the tobacco industry for the fabrication of internal reinforcing frames for cigarette packets, to which reference is made directly in the following specification albeit with no limitation in scope implied.

It is conventional practice in cigarette packaging machines to utilize devices of the type comprising a cutter and an anvil, in which the cutter and the anvil components are invested with sliding movement one relative to the other and caused to operate in conjunction at a cutting position in such a way as to divide up a continuous strip of paper material into discrete blanks each presenting the shape of a reinforcing frame for a rigid cigarette packet of the type with a hinged lid. The anvil is associated normally with a drive device such as will feed the strip in a predetermined direction along the anvil and toward an edge of the anvil that coincides with the aforementioned cutting position.

In familiar devices of the type outlined above, the cutter is operated by a relative drive or actuator device in such a manner as to pass across the anvil in a direction transverse to that followed by the advancing strip and through the cutting station. The action of the cutter may be either continuous or reciprocating; if continuous, the cutter will be mounted generally to the periphery of a roller set in rotation about its own axis in such a way that the cutting edge is caused to describe a circular trajectory passing tangentially to the anvil at the cutting position. When rotating cutters are used, a relatively short active cutting step is accompanied by a relatively long passive feed step in which the cutting edge advances toward the cutting position, since the edge has to complete one full revolution about its axis of rotation between two successive cutting strokes.

In the case of a reciprocating action, the cutter completes a forward stroke and a return stroke away from and back toward an at-rest position, passing through the cutting position each time. The forward stroke constitutes an operating step in which the cutting edge severs the paper strip by translating toward and striking against a corresponding edge of the anvil that coincides with the cutting position, whereas the return stroke is a passive movement serving simply to return the knife to the at-rest position.

It will be evident that cutting devices of the type described above are none too efficient. Whether the movement happens to be continuous or reciprocating, in effect, the active cutting stroke is accompanied by a relatively long passive stroke.

The object of the present invention is to provide a cutting device such as will be more efficient than devices of the prior art type described above.

SUMMARY OF THE INVENTION

The stated object is realized according to the present invention in a device for cutting a strip of sheet material into blanks that comprises an anvil, a cutter, first drive means by which the anvil and the cutter are set in relative cutting motion along a first predetermined direction and through a cutting position, and second drive means by which the strip is advanced toward the cutting position along a second predetermined direction substantially transverse to the first direction.

To advantage, the anvil affords a central passage proportioned to accommodate the strip, extending along the second direction and exhibiting an exit end that coincides with the cutting position; also, the relative cutting motion is a reciprocating movement, and the first drive means are designed in such a way that the cutter can be halted relative to the anvil in two limit positions located on opposite sides of the central passage, in which the passage is vacated by the cutter.

In the device disclosed, therefore, the cutter is reciprocated through a forward stroke and a return stroke, passing through the cutting position and severing the strip on the forward stroke and on the return stroke alike.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
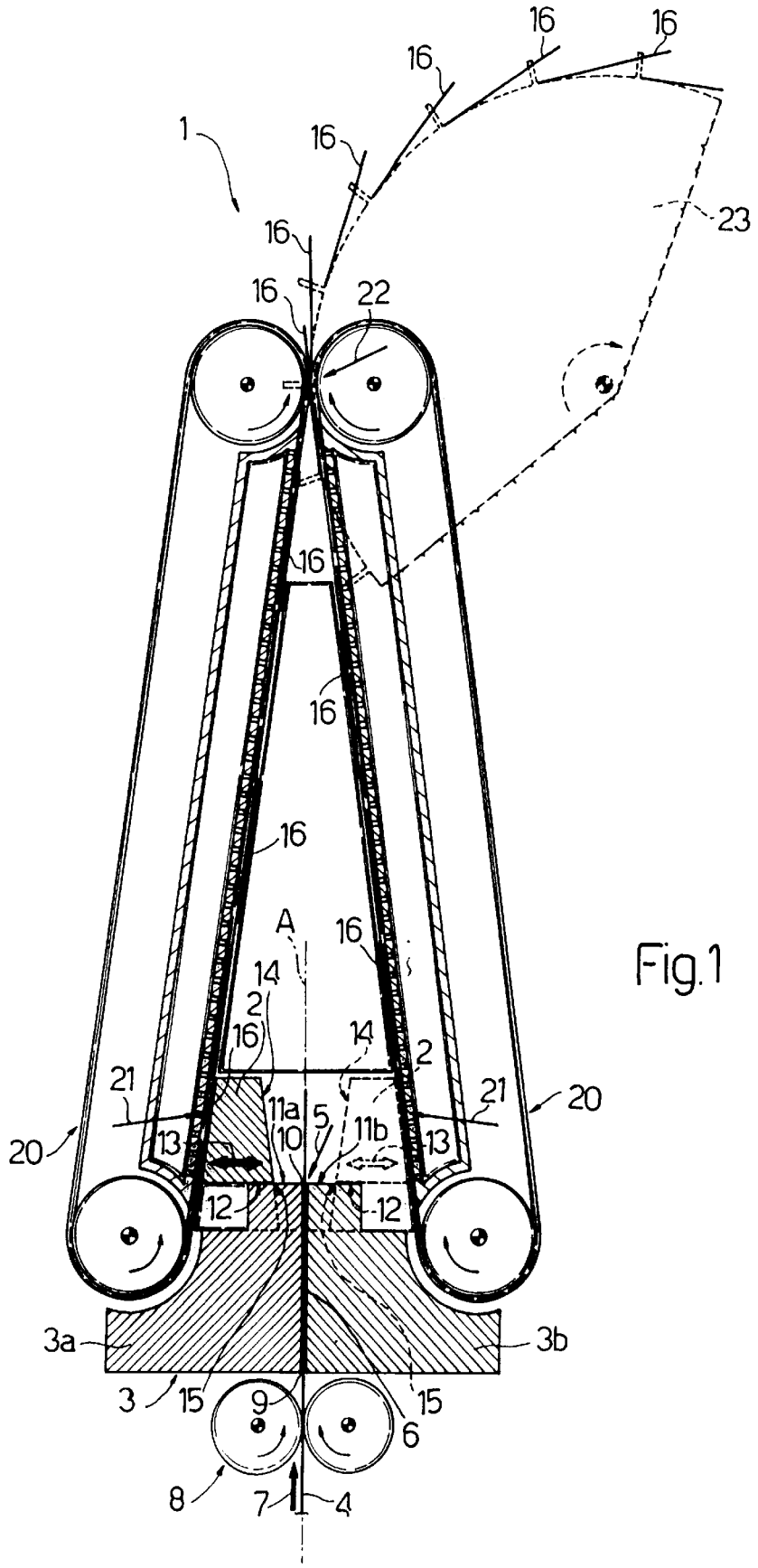
FIG. 1 illustrates a preferred embodiment of the device according to the present invention, viewed schematically in a side elevation and with certain parts omitted for clarity.
Figure 2:
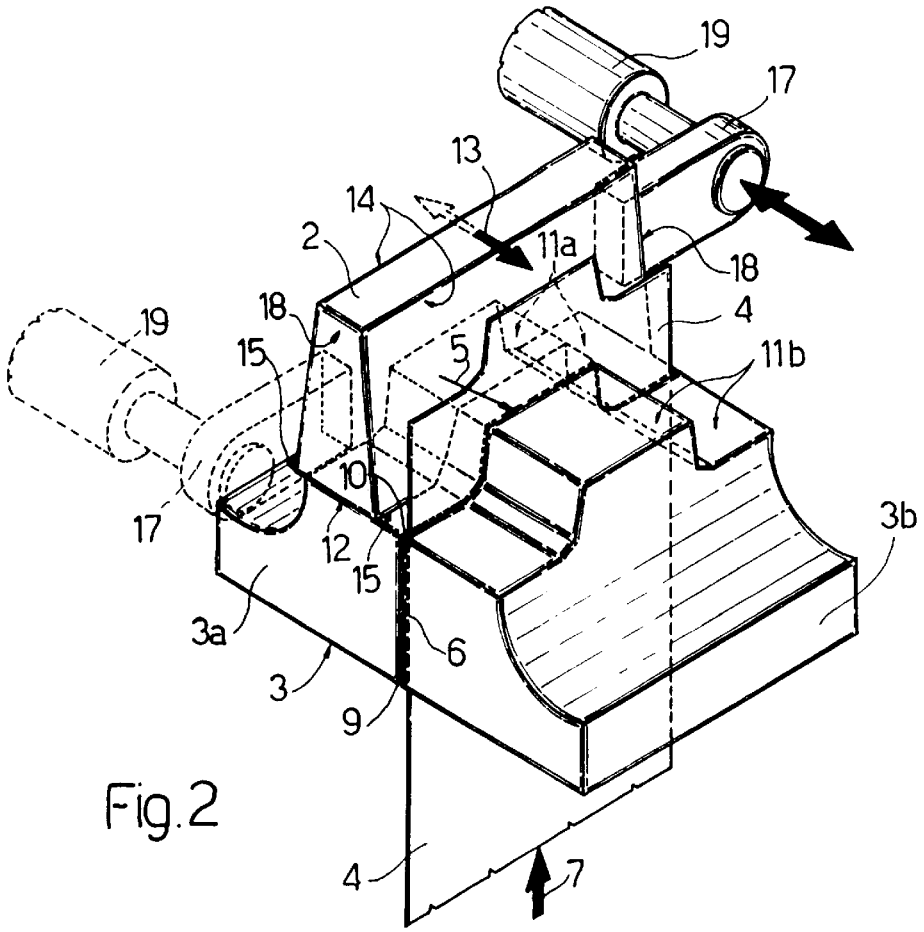
FIG. 2 is a detail of the device shown in FIG. 1, viewed in perspective.
Figure 3:
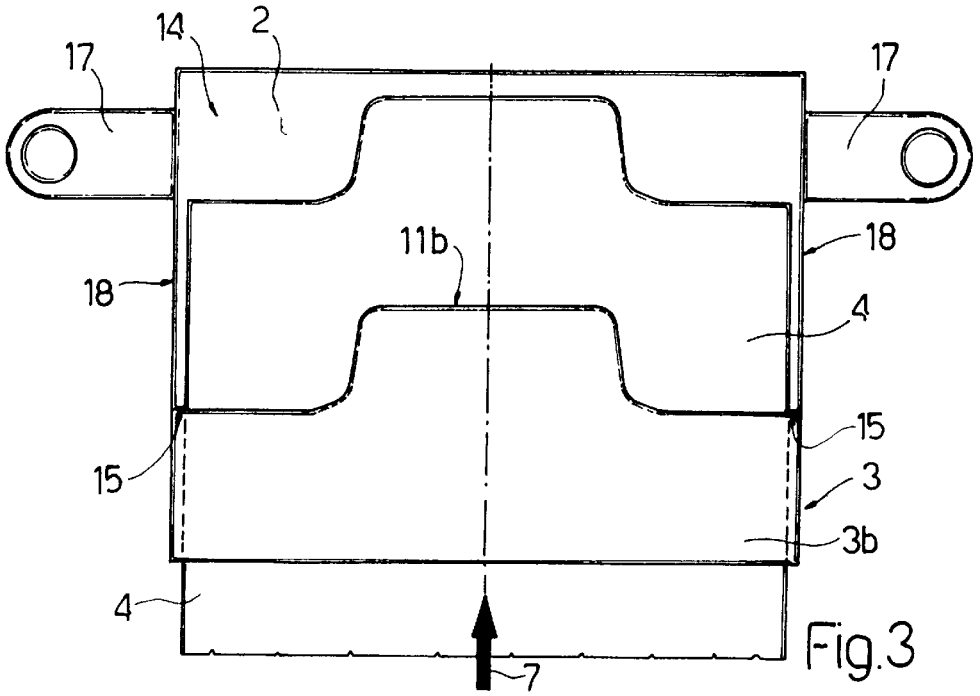
FIG. 3 illustrates the detail of FIG. 2 in a front elevation.

In the accompanying drawings, 1 denotes a cutting device, in its entirety, comprising a cutter 2 and an anvil 3 coupled slidably in such a way as to cut through a strip 4 of paper material at a cutting position denoted 5.

The anvil 3 is composed of two identical sections denoted 3*a* and 3*b*, matched one to the other and disposed symmetrically on either side of a vertical plane A.

The two anvil sections 3*a* and 3*b* afford respective flat surfaces breasted one with another parallel to the vertical plane A and separated by a distance marginally greater than the thickness of the paper strip 4, thus creating a passage 6 through which the strip 4 is made to advance when moving along a first predetermined direction 7, fed forward by a pinch roll device 8 of conventional embodiment. The passage 6 extends along the first direction 7 from an entry end 9 toward an exit end 10 that coincides with the cutting position 5.

Each of the two anvil sections 3*a* and 3*b* exhibits a relative top surface 11*a* and 11*b* coupled slidably with a bottom surface 12 of the cutter 2, allowing movement along a second direction 13 transverse to the vertical plane A and to the first direction 7. More exactly, the cutter 2 appears substantially prismatic in embodiment with a trapezoidal profile, and the aforementioned bottom surface 12 exhibits a central recess proportioned to couple slidably with a matching central projection afforded by each of the two corresponding top surfaces 11*a* and 11*b* of the anvil. The same bottom surface 12 also combines with two lateral faces 14 of the cutter 2, disposed transversely to the second direction 13, to create two respective cutting edges 15 angled and shaped in such a way as to slice through the paper at the cutting position 5 and divide up the strip 4 into discrete blanks 16 each presenting the flat outline of an internal reinforcing frame as incorporated into cigarette packets of the type having a hinged lid (not illustrated).

17 denotes one of two arms associated rigidly with the cutter 2, extending parallel to the vertical plane A from two opposite surfaces 18 of the cutter disposed transversely to the selfsame plane A. Each arm 17 is secured to the moving output member of a respective linear actuator 19. The function of the actuators is to reciprocate the cutter 2 along the second direction 13, through the cutting position 5 and between two limit positions in which both the cutting edges 15 are disposed on one side of the vertical plane A; that is to say, when occupying either one of the two limit positions, the cutter 2 remains coupled slidably with one only of the two anvil sections 3*a* or 3*b,* so that the exit end 10 of the passage 6 is left exposed.

The device 1 further comprises two aspirating type belt conveyors 20 of conventional embodiment, each extending through a respective transfer point 21 coinciding with one of the two aforementioned limit positions in such a way as to take up a blank 16 advanced by the corresponding face 14 of the cutter along the second direction 13 after passing through the cutting position 5. The two belt conveyors 20 extend substantially along the first direction 7, and combine geometrically with the anvil 3 to form an isosceles triangle in which the conveyors are the equal sides and the anvil provides the base. The function of the aspirating conveyors 20, which are also power driven, is to take up the discrete blanks 16 from the respective transfer points 21 and direct them toward a single transfer station 22 disposed at the vertex of the aforementioned triangle opposite to the base.

Lastly, the device 1 comprises a pocket conveyor 23 extending through the transfer station 22, which is power driven synchronously with the two aspirating belt conveyors 20 in such a way as to take up the blanks 16 singly and in alternation from these same two conveyors 20 at the transfer station 22.

In operation, the strip 4 is advanced by the pinch roll device 8 along the first direction 7, through the passage 6 and out of the exit end 10 in such a way as to reach the cutting position 5 at a moment when the cutter 2 occupies either one of the two limit positions.

The cutter 2 is now traversed by the actuators 19 along the second direction 13, through the cutting position 5 and toward the vacant limit position, with the result that the strip 4 is severed as the leading cutting edge 15 interacts with the relative anvil section 3*a* or 3 encountered along the second direction 13.

Immediately after the edge 15 has cut through the strip 4, the separated blank 16 will be carried by the advancing face 14 of the cutter 2 toward the corresponding transfer point 21, where it is taken up by the relative aspirating conveyor 20, carried toward the transfer station 22 and deposited in a pocket of the final conveyor 23.

The successive step of returning the cutter 2 to the opposite limit position occurs in the same way as described above and therefore needs no further comment, other than to reiterate that the cutter 2, advantageously, separates two blanks from the strip during each full cycle of reciprocating movement.

The operation of the pocket conveyor 23 is timed with that of the two aspirating belt conveyors 20 in such a manner that each two blanks 16 cut by two successive strokes of the cutter 2, away from and toward a given limit position, will be deposited in two successive pockets.

What is claimed:

1. A device for cutting a strip of sheet material into blanks, comprising an anvil, a cutter, first drive means by which the anvil and the cutter are set in relative cutting motion along a first predetermined direction and through a cutting position, and second drive means by which the strip is advanced toward the cutting position along a second predetermined direction substantially transverse to the first direction, wherein the anvil affords a central passage proportioned to accommodate the advancing strip, extending along the second direction and exhibiting an exit end that coincides with the cutting position, the relative cutting motion is a reciprocating movement, and the first drive means are designed in such a way that the cutter can be halted relative to the anvil in two limit positions located on opposite sides of the central passage, in which the passage is vacated by the cutter.

2. A device as in claim 1, wherein the relative motion consists in a reciprocatory sliding movement of the cutter across the anvil and through the cutting position.

3. A device as in claim 1, wherein the cutter is furnished with two opposite cutting edges disposed substantially transverse to the first and second directions and reciprocated slidably by the first drive means across the anvil and through the cutting position, ultimately assuming positions in which both the two edges are located on one or other side of the anvil relative to the cutting position.

4. A device as in claim 1, wherein the anvil is composed of two sections breasted one with another and separated by a given distance serving to establish the central passage.

5. A device as in claim 1, further comprising first and second conveyors located on opposite sides of the cutting position, each extending substantially along the second direction and through a respective limit position at which respective blanks are taken up in succession from the cutter.

6. A device as in claim 5, further comprising a third conveyor operating in conjunction with the first and the second conveyor at a transfer station where the respective blanks are received alternately from the selfsame first and second conveyors.

7. A device as in claim 5, wherein the first and second conveyors are aspirating belt conveyors disposed on either side of the anvil, arranged as two sides of an isosceles triangle in which the anvil forms the base.

8. A device as in claim 1, wherein the anvil and the cutter are shaped to generate a blank presenting the outline of a reinforcing frame for a rigid cigarette packet of the type with a hinged lid.

* * * * *